US009033376B2

(12) United States Patent
Bzorgi

(10) Patent No.: US 9,033,376 B2
(45) Date of Patent: May 19, 2015

(54) DELAYED UNLATCHING MECHANISM

(71) Applicant: Babcock & Wilcox Technical Services Y-12, LLC, Oak Ridge, TN (US)

(72) Inventor: Fariborz M. Bzorgi, Knoxville, TN (US)

(73) Assignee: Consolidated Nuclear Security, LLC, Reston, VA (US)

( * ) Notice: Subject to any disclaimer, the term of this patent is extended or adjusted under 35 U.S.C. 154(b) by 177 days.

(21) Appl. No.: 13/752,704

(22) Filed: Jan. 29, 2013

(65) Prior Publication Data

US 2013/0193696 A1 Aug. 1, 2013

Related U.S. Application Data

(60) Provisional application No. 61/593,618, filed on Feb. 1, 2012.

(51) Int. Cl.

| | |
|---|---|
| ***E05C 3/06*** | (2006.01) |
| ***E05B 51/02*** | (2006.01) |
| *E05C 3/00* | (2006.01) |
| *E05B 43/00* | (2006.01) |

(52) U.S. Cl.
CPC ..... *E05B 51/02* (2013.01); *E05B 2043/007* (2013.01); *E05B 2051/026* (2013.01)

(58) Field of Classification Search
USPC ..... 292/1, 194, 200, 201
See application file for complete search history.

(56) References Cited

U.S. PATENT DOCUMENTS

| | | | | |
|---|---|---|---|---|
| 2,763,888 | A * | 9/1956 | Billeter | 16/59 |
| 2,815,085 | A * | 12/1957 | Whipple | 180/289 |
| 3,113,447 | A * | 12/1963 | Oishei | 70/262 |
| 3,381,412 | A | 5/1968 | Brotherson | |
| 3,497,257 | A * | 2/1970 | Hirst, Jr. | 296/35.1 |
| 3,504,406 | A * | 4/1970 | Schott | 24/603 |
| 3,580,623 | A * | 5/1971 | Peters | 292/201 |
| 3,581,840 | A * | 6/1971 | Hirst et al. | 180/89.14 |
| 3,610,004 | A * | 10/1971 | Neese | 70/218 |
| 3,669,387 | A * | 6/1972 | Lucien | 244/102 SL |
| 3,692,353 | A * | 9/1972 | Lynde | 296/35.3 |
| 3,696,774 | A * | 10/1972 | Ostrem | 114/203 |
| 3,805,693 | A * | 4/1974 | Neitzel et al. | 100/255 |
| 3,823,586 | A | 7/1974 | Melancon | |
| 3,958,658 | A * | 5/1976 | Miyauchi et al. | 180/269 |
| 4,073,521 | A * | 2/1978 | Mena | 292/256.65 |
| 4,114,718 | A * | 9/1978 | Lipshield | 180/89.14 |
| 4,257,631 | A | 3/1981 | Logan, Jr. | |
| 4,313,631 | A * | 2/1982 | Johnson | 292/201 |
| 4,354,699 | A | 10/1982 | Logan | |

(Continued)

*Primary Examiner* — Carlos Lugo

(74) *Attorney, Agent, or Firm* — Luedeka Neely Group, P.C.

(57) ABSTRACT

In various embodiments an apparatus is presented for securing a structure such as a door, window, hatch, or gate that moves between an open and a closed position relative to a fixed structure to provide or deny access to a compartment, a room, an outdoor area, or a facility. Various embodiments provide a delay in opening the closure of sufficient duration to frustrate a rapid activation that might be desired by a person who is attempting to pass through the closure for some illicit purpose. Typically, hydraulics are used to activate the apparatus and no electrical energy or electronic signals are employed. In one embodiment, a plurality of actuations of a hand lever operates a hydraulic pump that moves a locking bolt from a first position in which a locking bolt is engaged with a recess in the fixed structure (preventing opening of a gate) to a second position in which the locking bolt is disengaged from the recess to permit opening of the gate.

19 Claims, 2 Drawing Sheets

(56) References Cited

U.S. PATENT DOCUMENTS

| | | | | | |
|---|---|---|---|---|---|
| 4,413,694 | A | * | 11/1983 | Slocombe et al. | 180/89.14 |
| 4,703,962 | A | | 11/1987 | Kelly et al. | |
| 5,083,342 | A | | 1/1992 | Klinefelter | |
| 5,288,037 | A | * | 2/1994 | Derrien | 244/102 SL |
| 5,290,076 | A | * | 3/1994 | Smith | 292/25 |
| 5,294,157 | A | * | 3/1994 | Smith et al. | 292/25 |
| 5,735,557 | A | * | 4/1998 | Harvey | 292/216 |
| 5,799,516 | A | * | 9/1998 | Zintler | 70/92 |
| 5,857,647 | A | * | 1/1999 | Jakubowski, Jr. | 244/137.4 |
| 7,510,224 | B2 | * | 3/2009 | Bacco et al. | 292/340 |
| 7,735,884 | B2 | * | 6/2010 | Bacco et al. | 292/340 |
| 7,832,778 | B2 | | 11/2010 | Whitaker et al. | |
| 2007/0013197 | A1 | * | 1/2007 | Bender et al. | 292/201 |
| 2007/0227348 | A1 | | 10/2007 | Bakker et al. | |
| 2009/0084037 | A1 | | 4/2009 | Bzorgi | |
| 2009/0146438 | A1 | | 6/2009 | Viaud et al. | |
| 2010/0034678 | A1 | | 2/2010 | Weber | |

* cited by examiner

DELAYED UNLATCHING MECHANISM

CROSS REFERENCE TO RELATED APPLICATION

This patent application claims priority from and is related to U.S. Provisional Patent Application No. 61/593,618 filed Feb. 2, 2012, entitled "Delayed Unlatching Mechanism." Provisional Patent No. 61/593,618 is incorporated by reference in its entirety herein.

GOVERNMENT RIGHTS

The U.S. Government has rights to this invention pursuant to contract number DE-AC05-00OR22800 between the U.S. Department of Energy and Babcock & Wilcox Technical Services Y-12, LLC.

FIELD

This disclosure relates to the field of latching mechanisms. More particularly, this disclosure relates to latching mechanisms that provide a delay time between initiation of an unlocking action and the time at which the latch is unlocked.

BACKGROUND

In certain circumstances, particularly situations pertaining to facility security, it is desirable to delay the passage of a person through an entrance or an exit for a small interval of time, such as for several seconds or up to a minute or so. Typically the purpose of such a delay is to give security personnel time to assess the appropriateness of the person's intent to pass through the exit or entrance. Often authorization to proceed is provided by an electronic signal to unlock the passageway. Generally such electronic signals are initiated remotely by a person in authority, such as a guard in a control room viewing a security camera, or a person who verifies the identity of the requester through a two-way audio connection. However, there are many circumstances where such entrances or exits are routine and very rarely should such a passage be denied. In such circumstances it is generally sufficient to delay the person's entrance or exit for a period of time that is sufficient to allow an authority to inhibit the exit/entry process only in the rare instance where such passage should be denied. Also there are many circumstances where such passageways are remotely located and electronic monitoring and control is impractical. Current systems often fail to efficiently meet certain requirements set by these circumstances. What are needed therefore are improved systems and methods for delaying the passage of a person through an entrance or an exit for a small interval of time.

SUMMARY

In one embodiment the present disclosure provides an apparatus for securing a closure that opens by movement relative to a fixed structure having a locking bolt recess. The apparatus includes a locking bolt for engaging the locking bolt recess to prevent the opening of the closure. There is a latching lever (either balanced or imbalanced) that operatively couples with the locking bolt so that the latching lever moves between (a) a latching lever locked position in which the locking bolt is disposed in a first position engaged with the locking bolt recess for inhibiting opening of the closure and (b) a latching lever unlocked position in which the locking bolt is disposed in a second position disengaged from the locking bolt recess for permitting opening of the closure. In this embodiment a bias spring is provided to bias the latching lever in the latching lever locked position. A catch is provided, the catch having a holding configuration and a releasing configuration. There is a hydraulic cylinder that has a high pressure chamber and an atmospheric pressure chamber that are separated by a piston that is operatively engaged with a ram for engaging the latching lever. A hydraulic fluid reservoir (that is separate from the hydraulic cylinder) is provided and the hydraulic fluid reservoir holds a hydraulic fluid with a pressure head that is at atmospheric pressure. A pump is provided to extract a portion of the hydraulic fluid from the reservoir and transfer it at a pressure greater than atmospheric pressure through a hydraulic fluid line to the high pressure chamber of the hydraulic cylinder. A hydraulic fluid return line is used to return hydraulic fluid from the high pressure chamber to the hydraulic fluid reservoir, and a relief valve is disposed in the hydraulic fluid return line. The relief valve has an open position and a closed position. When the relief valve is in the closed position, at least one cycle of the pump pressurizes the high pressure chamber, which moves the piston, which moves the ram, which moves the latching lever (against a force of the bias spring) from the latching lever locked position to the latching lever unlocked position, which moves the locking bolt from the first position engaged with the locking bolt recess to the second position disengaged with the locking bolt recess, which moves the catch to the holding configuration, such that the latching lever is retained in the unlocked position. When the relief valve is in the open position and the catch is moved from the holding configuration to the releasing configuration, the bias spring moves the latching lever to the locked position, which moves the locking bolt to the first position engaged with the locking bolt recess. The bias spring also then moves the ram, which moves the piston, which moves a portion of the hydraulic fluid in the high pressure chamber back to the fluid reservoir through the hydraulic fluid return line.

In another embodiment, an apparatus is provided for securing a closure that opens by movement relative to a fixed structure having a locking bolt recess. In this embodiment the apparatus includes a locking bolt for engaging the locking bolt recess to prevent the opening of the closure. An imbalanced latching lever is provided, where the imbalanced latching lever is operatively coupled with the locking bolt such that the imbalanced latching lever moves between (a) an imbalanced latching lever locked position in which the locking bolt is disposed in a first position engaged with the locking bolt recess for inhibiting opening of the closure and (b) an imbalanced latching lever unlocked position in which the locking bolt is disposed in a second position disengaged from the locking bolt recess for permitting opening of the closure. The imbalanced latching lever is weight biased in the imbalanced latching lever locked position. Also provided is a catch having a holding configuration and a releasing configuration. There is a hydraulic cylinder having a high pressure chamber and an atmospheric pressure chamber that are separated by a piston that is operatively engaged with a ram for engaging the imbalanced latching lever. Further provided is a hydraulic fluid reservoir that is separate from the hydraulic cylinder. The hydraulic fluid reservoir holds a hydraulic fluid with a pressure head that is at atmospheric pressure. A pump is provided to extract a portion of the hydraulic fluid from the reservoir and transfer it at a pressure greater than atmospheric pressure through a hydraulic fluid line to the high pressure chamber of the hydraulic cylinder. A hydraulic fluid return line is used to return hydraulic fluid from the high pressure chamber to the hydraulic fluid reservoir, and a relief valve is disposed in the hydraulic fluid return line. The relief valve has an open position and a closed position. When the relief valve is in the closed position, at least one cycle of the pump pressurizes the high pressure chamber, which moves the piston, which moves the ram, which moves the imbalanced latching lever (against the weight bias of the imbalanced latching lever) from the imbalanced latching lever locked position to the imbalanced latching lever unlocked position, which moves the locking bolt from the first position engaged with the locking bolt recess to the second position disengaged with the locking bolt recess, which moves the catch to the holding configuration wherein the imbalanced latching lever is retained in the imbalanced latching lever unlocked position. When the relief valve is in the open position and the catch is moved from the holding configuration to the releasing configuration, the weight bias of the imbalanced latching lever moves the imbalanced latching lever to the imbalanced latching lever locked position, which moves the locking bolt to the first position engaged with the locking bolt recess, and the weight bias of the imbalanced latching lever moves the ram, which moves the piston, which moves a portion of the hydraulic fluid in the high pressure chamber back to the fluid reservoir through the hydraulic fluid return line.

In some embodiments the pump is a hand pump that is actuated by a pump lever and a plurality of actuations of the pump lever causes a plurality of cycles of the pump to pressurize the high pressure chamber. Some embodiments include a gap spring that moves the ram when the relief valve has moved from the closed position to the open position.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

In the following detailed description of the preferred and other embodiments, reference is made to the accompanying drawings, which form a part hereof, and within which are shown by way of illustration the practice of specific embodiments of an apparatus for securing a closure that opens by movement relative to a fixed structure having a locking bolt recess. It is to be understood that other embodiments may be utilized, and that structural changes may be made and processes may vary in other embodiments.

Figure 1:
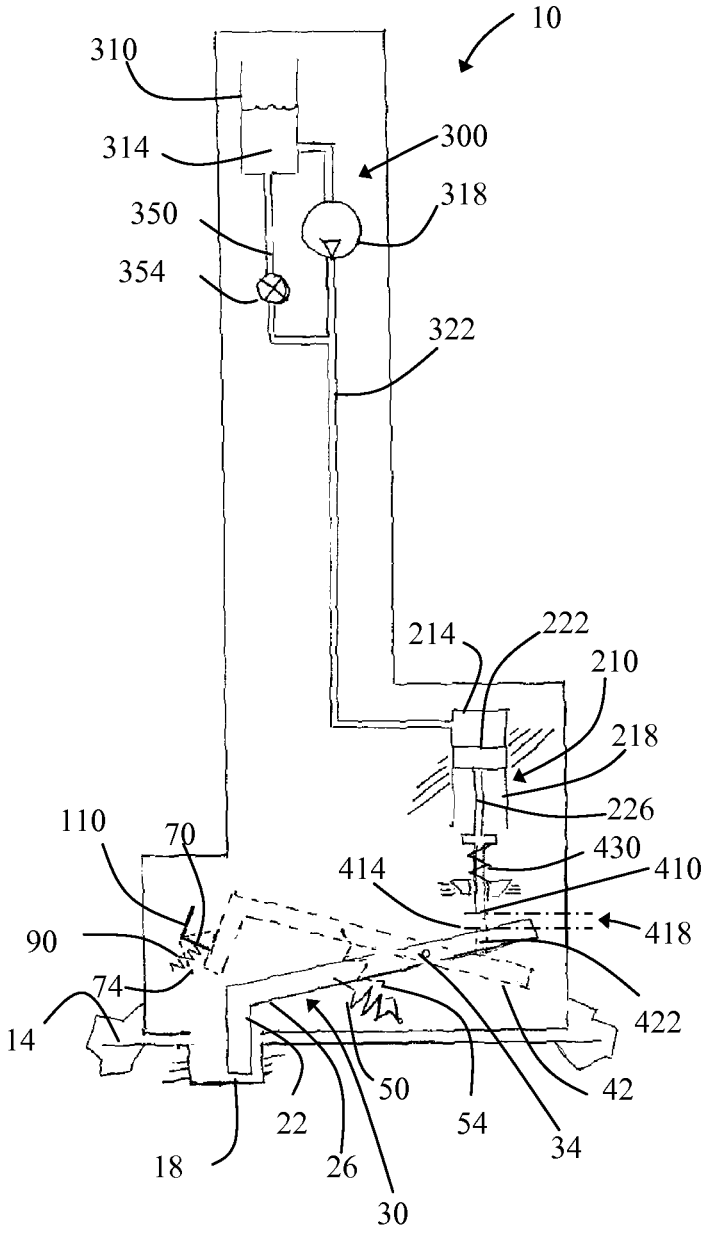
FIG. 1 is a somewhat schematic elevation view of an apparatus for securing a closure that opens by movement relative to a fixed structure.

FIG. 1 illustrates one embodiment of an apparatus 10 for securing a closure that opens by movement relative to a fixed structure having a locking bolt recess. As the term is used herein, a "closure" is a structure such as a door, window, hatch, or gate that moves between an open and a closed position to provide or deny access to a compartment, a room, an outdoor area, or a facility.

In FIG. 1, the fixed structure relative to which the apparatus 10 moves is a floor 14. The floor 14 has a locking bolt recess 18. A locking bolt 22 is disposed in the locking bolt recess 18, and the locking bolt 22 engages the locking bolt recess 18 to prevent the opening of the closure. In the embodiment illustrated in FIG. 1, there is potentially considerable lateral mechanical "play" (unimpeded motion) between the locking bolt 22 and the locking bolt recess 18. The term "lateral" is used here to refer to a horizontal direction in the plane of the page on which FIG. 1 is presented. In many embodiments, the apparatus 10 is disposed on a closure that moves (at least initially) relative to the fixed structure (i.e., the floor 14 in this embodiment) in a direction that is orthogonal to (into or out from) the page on which FIG. 1 is presented. In such embodiments, movement of the locking bolt 22 with respect to the locking bolt recess 18 may be negligible. In other words, the apparatus 10 is configured such that when opening the closure there is virtually no mechanical play between the locking bolt 22 and the locking bolt recess 18, and, therefore, virtually no movement or opening of the closure is possible until the locking bolt 22 is retracted from the locking bolt recess 18.

The apparatus 10 further includes a latching lever 26 that is operatively coupled with the locking bolt 22. In the embodiment of FIG. 1, the latching lever 26 is operatively coupled with the locking bolt 22 by virtue of the latching lever 26 and locking bolt 22 being formed as one piece, namely latch 30. Typically, the latch 30 is formed from steel that is approximately ¾ inch (2 cm) thick. The latching lever 26 moves around a pivot point 34 to move the locking bolt 22 between (a) a locked position (shown in solid lines) where the locking bolt 22 is engaged with the locking bolt recess 18 for inhibiting opening of the closure, and (b) an unlocked position (shown in dashed lines 42) in which the locking bolt is disengaged from the locking bolt recess for permitting opening of the closure.

In certain embodiments, including the embodiment of FIG. 1, the latching lever 26 is an imbalanced latching lever, meaning that its distribution of weight (including any other equipment elements formed integrally with the latching lever 26, such as the locking bolt 22) around the pivot point 34 establishes a weight bias that biases the latching lever 26 toward a locked position (as shown by solid lines). As used herein, the term "formed integrally" refers to an assembly of elements that are fixedly configured by weldment, bolts, adhesive bonds, or similar attaching mechanisms, or an article that incorporates such other equipment elements formed as a monolithic structure with the latching lever. According to other embodiments, the latching lever 26 is a balanced latching lever, meaning that its distribution of weight (including any other equipment elements formed integrally with the latching lever 26, such as the locking bolt 22) around the pivot point 34 is essentially balanced such that the latching lever is neither substantially biased toward the locked position nor the unlocked position.

In preferred embodiments, the apparatus 10 further includes a bias spring 50 that biases the latching lever 26 in the locked position. In embodiments having an imbalanced latching lever, both the bias spring and the imbalanced latching lever bias the latching lever 26 towards the locked position. In embodiments where a balanced latching lever is used, the bias spring 50 may be the only source that provides a bias to the latching lever towards the locked position. When the latching lever 26 is moved to the unlocked position, the bias spring 50 must be stretched as shown by the dashed lines 54.

It is the tension force generated by this stretching of the bias spring 50 that biases the latching lever 26 back toward the locked position.

The apparatus 10 includes a catch 70 for assisting in retaining the latching lever 26 in the unlocked position, which is illustrated in a highly symbolic depiction in FIG. 1. The catch 70 has a holding configuration where the catch 70 assists in retaining the latching lever 26 in the unlocked position (illustrated by the solid lines of the catch 70 in FIG. 1) and a releasing configuration where the catch 70 does not impede the movement of the latching lever 26 that is biased to the locked position (shown symbolically by the dashed lines 74). As further explained below, a compression spring 90 preferably retains the catch 70 in the holding configuration, and a releasing mechanism such as manual movement of a lever portion 110 in a clockwise direction is used to momentarily move the catch to the releasing configuration.

The apparatus 10 of FIG. 1 further includes a hydraulic cylinder 210. The hydraulic cylinder 210 has a high pressure chamber 214 and an atmospheric pressure chamber 218. The pressure in the atmospheric pressure chamber 218 is constant (at atmospheric pressure) during the operation of the apparatus 10. The high pressure chamber 214 and the atmospheric pressure chamber 218 are separated by a piston 222 that moves based on fluid pressure within the hydraulic cylinder. The piston 222 is operatively engaged with a ram 226. The ram 226 is operable to engage the latching lever 26 upon movement of the piston towards the atmospheric pressure chamber 218 of the hydraulic cylinder 210 to move the latching lever from the latching lever locked position to the latching lever unlocked position. In certain embodiments, when the latching lever 26 is in the locked position as shown in the embodiment of FIG. 1, an end 410 of the ram 226 is displaced from its contact point 414 on the latching lever 26 by a gap distance 418. When the piston 222 and ram 226 move downward (by a system such as a hydraulic system 300 subsequently described herein), the end 410 of the ram 226 contacts the latching lever 26 at the contact point 414. The portion of the ram above the end 410 then continues to move to the position indicated by dashed lines 422.

The motion of the piston 222 and ram 226 is controlled by hydraulic system 300. The hydraulic system 300 includes a hydraulic fluid reservoir 310 that is separate from the hydraulic cylinder 210. The hydraulic fluid reservoir 310 holds a hydraulic fluid 314. The pressure head of the hydraulic fluid 314 in the hydraulic fluid reservoir is constant (at atmospheric pressure) during the operation of the apparatus 10.

A pump 318 extracts a portion of hydraulic fluid 314 from the hydraulic fluid reservoir 310 and transfers it under a pressure greater than atmospheric pressure through a hydraulic fluid line 322 to the high pressure chamber 214 of the hydraulic cylinder 210. The transfer of the pressurized hydraulic fluid 314 from the hydraulic fluid reservoir 310 to the hydraulic cylinder 210 causes the piston 222 and ram 226 to move in the hydraulic cylinder 210 towards the latching lever 26 to move the lever from the latching lever locked position to the latching lever unlocked position.

The apparatus 10 also includes a hydraulic fluid return line 350, which, in combination with the hydraulic fluid line 322, is used to return a portion of the hydraulic fluid 314 from the high pressure chamber 214 to the hydraulic fluid reservoir 310. A relief valve 354 is disposed in the hydraulic fluid return line 350. The relief valve 354 has an open position and a closed position. When the relief valve 354 is in the closed position, at least one cycle (a stroke or a revolution) of the pump 318 pressurizes the high pressure chamber 214. The pressurization of the high pressure chamber 214 moves the piston 222, which moves the ram 226, which moves the latching lever 26 (against a force of the bias spring 50), which moves the locking bolt 22 from the position engaged with the locking bolt recess 18 to the position (illustrated by the dashed lines 42) in which the locking bolt 22 is disengaged with the locking bolt recess 18. As the latching lever 26 is moved to its unlocked position, the catch 70 moves to its holding configuration for retaining the latching lever 26 in its unlocked position. The number of cycles of the pump 318 required to move the latching lever 26 from the locked position to the unlocked position may be adjusted by such design considerations as the flow rate of the pump 318, the volume of the high pressure chamber 214, the strength of the bias spring 50, and other parameters well understood by artisans in the field of hydraulic pressure system design.

The process of moving the latching lever 26 from the locked position to the unlocked position, which moves the locking bolt 22 from the position in which it is engaged with the locking bolt recess 18 to the position in which the locking bolt 22 is disengaged with the locking bolt recess 18, causes a desirable delay in permitting the opening of the closure to which the apparatus 10 is attached. This delay provides an interval of time for an authority to observe (such as by a remote camera and a closed circuit television monitor) that a person is opening the closure. Such delay may be used to activate an alarm or to activate an override system that prevents opening of the closure.

When the relief valve 354 is in the open position and the catch 70 is moved from its holding configuration to its releasing configuration, forces of the weight bias of the latching lever 26 and/or from the bias spring 50 move the latching lever 26 downward, which moves the locking bolt 22 to the position in which it is engaged with the locking bolt recess 18. Forces of the weight bias of the latching lever and the bias spring 50 also move the ram 226, which moves the piston 222, and which moves a portion of the hydraulic fluid 314 in the high pressure chamber 214 back to the hydraulic fluid reservoir 310 through the hydraulic fluid return line 350.

As previously noted, in the embodiment of FIG. 1 when the latching lever is in the locked position, there is preferably a gap distance 418 separating the end 410 of the ram 226 from its contact point 414 on the latching lever 26. A gap spring 430 is preferably employed in the gap distance 418. In embodiments where the gap spring 430 is employed, the pump 318 pressurizes the high pressure chamber 214 with sufficient force to move the piston 222 and the ram 226 against a force of the gap spring 430 (as well as against the force of the bias spring 50 and the weight imbalance of the latching lever if the latching lever is imbalanced. Embodiments employing the gap spring 430 may be used to extend the desirable delay experienced in opening the closure. In addition, the gap distance 418 provides an additional period of "dead time" between activation of the pump 318 and any movement of the locking bolt 22, which may cause a person who is attempting to open the closure for illicit purposes to conclude that the attempt to open the closure is not working and therefore abandon the attempt.

Figure 2:
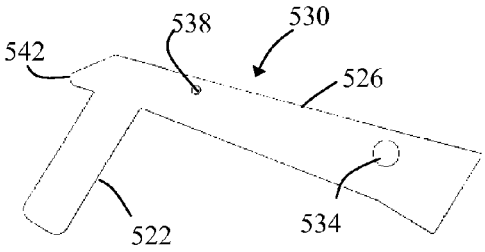
FIG. 2 is a somewhat schematic view of a latch that may be used in the apparatus of FIG. 1.

FIG. 2 illustrates an embodiment of a latch 530 according to one embodiment of the disclosure that includes a locking bolt 522 and a latching lever 526. A hole 534 is preferably provided for insertion of a pivot pin as a point of rotation of the latch 530. The latch 530 further includes a release pin 538 for manually raising the latch 530 to disengage the locking bolt 522 from a locking bolt recess (without use of the hydraulic system 300). The release pin 538 is provided only on a side of a closure that is "unprotected," meaning a side of the closure for which the apparatus for securing the closure is not intended to provide a delayed passage. The latch 530 further includes a wedge 542, the function of which is described with respect to FIG. 3.

Figure 3:
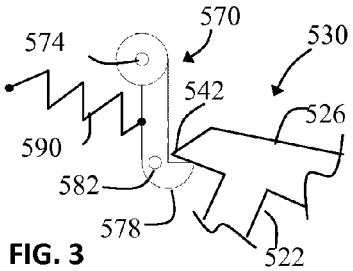
FIG. 3 is a somewhat schematic side view of a catch and a compression spring, which may be used in the apparatus of FIG. 1.

FIG. 3 illustrates one embodiment of a catch 570 shown in a holding configuration. The catch 570 rotates around a pivot 574. The catch 570 includes a notched lobe 578. When the latching lever 526 of FIG. 2 moves upward (from its locked position toward its unlocked position), the wedge 542 deflects the notched lobe 578 in a counterclockwise rotation of the catch 570 against the force of a compression spring 590. When the upward movement of the latching lever 526 reaches the position illustrated in FIG. 3, the compression spring 590 has moved the catch 570 in a counterclockwise rotation and the wedge 542 of the latch 570 is captured by the notched lobe 578. This establishes the holding configuration of the catch 570. A release mechanism such as swing pin 582 is preferably provided to manually move the catch 570 in a clockwise rotation to its releasing configuration such that the latching lever 526 may then move downwardly. Alternatively, upon the relief valve 354 moving to the open position and the hydraulic fluid 314 in the high pressure chamber 214 returning to the hydraulic fluid reservoir 310, sufficient downward pressure could be placed on the catch 570 by the latching lever 526 to cause the catch 570 to move to its releasing configuration.

Figure 4:
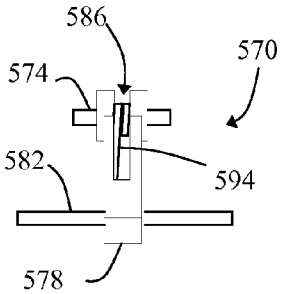
FIG. 4 is a somewhat schematic front view of the catch (of FIG. 3) and a torsion spring, which may be used in the apparatus of FIG. 1.

FIG. 4 illustrates a front view of the catch 570, presenting a more illustrative depiction of the pivot 574 and the swing pin 582. FIG. 4 also illustrates a channel 586 that is formed in the catch 570. In the embodiment of FIG. 4, the compression spring 590 of FIG. 3 has been replaced with a torsion spring 594 that is disposed around the pivot 574. The torsion spring 594 biases the notched lobe 578 in a counterclockwise direction around the pivot 574 (counterclockwise as viewed in FIG. 3).

Figure 5:
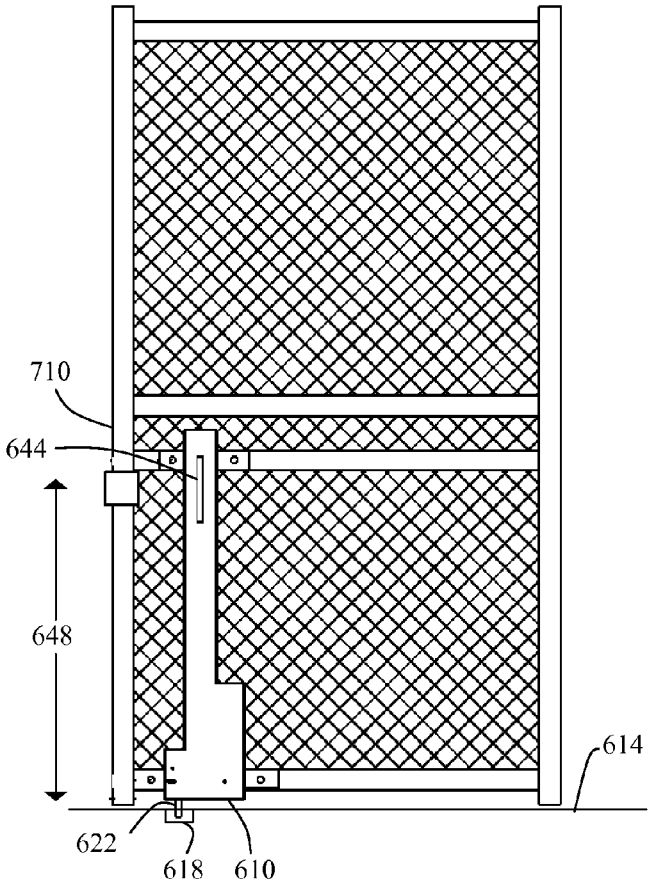
FIG. 5 is a somewhat schematic view of the apparatus of FIG. 1 installed on a gate.

FIG. 5 illustrates a typical application of an apparatus 610 for securing a closure that opens by movement relative to a fixed structure (e.g., the floor 614) having a locking bolt recess 618. The apparatus 610 is secured to a gate 710. A pump lever 644 is provided to actuate a hydraulic pump (such as pump 318 depicted in FIG. 1), and at least one actuation (and preferably a plurality of actuations) of the pump lever 644 causes at least one cycle (and preferably a plurality of cycles) of the hydraulic pump to pressurize a high pressure chamber (such as the high pressure chamber 214 of FIG. 1). In the embodiment of FIG. 5, the pump lever 644 is positioned at an elevation 648 that provides convenient accessibility. In alternate embodiments the elevation 648 may be much lower than depicted in FIG. 5, in which case the apparatus 610 may be correspondingly shorter in height.

In many applications it is appropriate to delay passage through a portal only in one direction, and permit substantially undelayed passage in the opposing direction. If the embodiment of FIG. 5 is used in such an application, the hydraulic system is accessed by the pump lever 644 from the delayed direction, which is the direction viewed in FIG. 5. Then from the opposing direction, a release pin (such as release pin 538 depicted in FIG. 2) may be provided to manually raise the latching lever (e.g., latching lever 526 of FIG. 2) into its holding position depicted in FIG. 3, such that the gate 710 may be quickly opened from that direction. A releasing mechanism of a catch may also be accessible from the opposing direction such that the catch may be moved to its releasing configuration for lowering the latching lever after moving through the portal. In other applications it is appropriate to delay passage through a portal from both directions. In such applications the hydraulic system is accessed by a handle on each side, and no release pin is provided on either side.

While the apparatus 10 of FIG. 1 and apparatus 610 of FIG. 5 are depicted with their locking bolts (22 and 622, respectively) in a vertical orientation, and the locking bolt recesses (18 and 618, respectively) are depicted in a floor (14 and 614, respectively), in other embodiments the locking bolts may be oriented in different directions and the locking bolt recesses may be located in different portions of a fixed structure. Furthermore, multiple apparatuses for securing a closure that opens by movement relative to a fixed structure may be employed on one such closure.

In summary, various embodiments disclosed herein provide an apparatus for securing a closure that opens by movement relative to a fixed structure having a locking bolt recess. Various embodiments provide a delay in opening the closure of sufficient duration to frustrate a rapid activation that might be desired by a person who is attempting to pass through the closure for some illicit purpose. Various embodiments employ hydraulic power to activate the mechanisms. Hydraulic power has the advantage of generating large forces which may be needed to overcome situations where, for example, the apparatus is used very infrequently, and has sat idle for an extended period of time, and has become "stuck" due to rusting, warping, settling, or other changes that may develop as equipment ages or when it is not used for an extended period of time. Typically, embodiments of an apparatus for securing a closure only utilize manual power to activate the mechanisms that move the latching lever (e.g., the latching lever 26) from the locked position to the unlocked position. In such manually-powered systems, the amount of delay in opening the door is a function of (1) the number of cycles of a pump (e.g., the pump 318) that is required to move a latching lever (e.g., the latching lever 26) from the locked position to the unlocked position, and (2) the time it takes a person to manually activate the required number of cycles of the pump, such as by use of a pump lever (e.g., the pump lever 644). Typical embodiments include a fail-safe locking feature. That is, if the device is damaged, it cannot be opened from a "protected" side (meaning a side of the closure for which the apparatus for securing the closure is providing a delayed passage.)

While electronic power could be used to operate various aspects of the closure securing apparatus, preferred embodiments provide a closure securing apparatus that activates and operates with no electrical power, and/or no electro-mechanical switches (such as solenoids).

The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. An apparatus for securing a closure that opens by movement relative to a fixed structure having a locking bolt recess, the apparatus comprising:

a locking bolt for engaging the locking bolt recess to prevent the opening of the closure;

a latching lever operatively coupled with the locking bolt wherein the latching lever moves between (a) a latching lever locked position in which the locking bolt is disposed in a first position engaged with the locking bolt recess for inhibiting opening of the closure and (b) a latching lever unlocked position in which the locking bolt is disposed in a second position disengaged from the locking bolt recess for permitting opening of the closure;

a hydraulic cylinder having a high pressure chamber and an atmospheric pressure chamber separated by a piston that is operatively engaged with a ram for moving the ram between a first ram position in which the ram is disengaged from the latching lever and a second ram position for engaging the latching lever;

a hydraulic fluid reservoir in flow communication with the hydraulic cylinder, the hydraulic fluid reservoir holding a hydraulic fluid;

a pump to extract a portion of the hydraulic fluid from the reservoir and transfer it at a pressure greater than atmospheric pressure through a hydraulic fluid line to the high pressure chamber of the hydraulic cylinder;

a pump actuator accessible to a user from at least one side of the closure, wherein each actuation of the pump actuator causes at least one cycle of the pump, each cycle of the pump for transferring a portion of the hydraulic fluid from the reservoir to the high pressure chamber causing the piston to move the ram towards the second ram position; and a gap distance disposed between the ram in the first ram position and the latching lever, the gap distance for controlling a number of cycles of the pump required to move the ram from the first ram position through the gap distance to the second ram position for engaging the latching lever and causing the latching lever to move from the latching lever locked position to the latching lever unlocked position.

2. The apparatus of claim 1 wherein the pump is a hand pump and the pump actuator is a pump lever.

3. The apparatus of claim 1 further comprising a bias spring to bias the latching lever in the latching lever locked position.

4. The apparatus of claim 1 wherein the latching lever is weight imbalanced to bias the latching lever in the latching lever locked position.

5. The apparatus of claim 1 further comprising a catch having a holding configuration for assisting in retaining the latching lever in the latching lever unlocked position, the catch including a releasing mechanism for moving the catch from the holding configuration to a releasing configuration such that the latching lever returns to the latching lever locked position.

6. The apparatus of claim 1 further comprising:

a hydraulic fluid return line in flow communication with the hydraulic cylinder and the hydraulic fluid reservoir for returning hydraulic fluid from the high pressure chamber to the hydraulic fluid reservoir; and a relief valve disposed in the hydraulic fluid return line, the relief valve having an open position and a closed position, the pump being operable to pressurize the high pressure chamber to move the latching lever from the latching lever locked position to the latching lever unlocked position when the relief valve is in the closed position, and wherein a portion of the hydraulic fluid moves from the high pressure chamber to the hydraulic fluid reservoir when the latching lever is moved from the latching lever unlocked position to the latching lever locked position and the relief valve is in the open position.

7. The apparatus of claim 6 further comprising a gap spring that moves the ram towards the high pressure chamber when the relief valve has moved from the closed position to the open position.

8. A delay unlatching mechanism for a closure comprising:

a latching lever operable to move between a latching lever locked position for inhibiting opening of the closure and a latching lever unlocked position for permitting opening of the closure;

a hydraulic fluid reservoir holding a hydraulic fluid;

a hydraulic cylinder in flow communication with the hydraulic fluid reservoir, the hydraulic cylinder including a piston coupled to a ram, the ram operable to move between a first ram position and a second ram position, the ram engaging the latching lever and moving the latching lever from the latching lever locked position to the latching lever unlocked position in the second ram position;

a pump to extract a portion of the hydraulic fluid from the reservoir and transfer it at a pressure greater than atmospheric pressure to the hydraulic cylinder during wherein each cycle of the pump pressurizes the hydraulic cylinder causing movement of the piston in the hydraulic cylinder such that the ram moves from the first ram position towards the second ram position;

a pump actuator accessible to a user from at least one side of the closure wherein one actuation of the pump actuator causes at least one cycle of the pump; and delaying in means for controlling a number of actuations of the pump actuator required to move the ram from the first ram position to the second ram position.

9. The delay unlatching mechanism of claim 8 wherein the pump is a hand pump and the pump actuator is a pump lever.

10. The delay unlatching mechanism of claim 9 wherein the pump lever is accessible from only one side of the closure.

11. The apparatus of claim 8 further comprising a bias spring to bias the latching lever in the latching lever locked position.

12. The apparatus of claim 11 wherein the delaying means includes controlling the number of actuations of the pump actuator required to move the ram from the first ram position to the second ram position by controlling the force of the bias spring towards the latching lever locked position.

13. The apparatus of claim 8 wherein the latching lever is weight imbalanced to bias the latching lever in the latching lever locked position.

14. The apparatus of claim 13 wherein the delaying means includes controlling the number of actuations of the pump actuator required to move the ram from the first ram position to the second ram position by controlling the weight imbalance of the latching lever towards the latching lever locked position.

15. The apparatus of claim 8 further comprising a catch having a holding configuration for assisting in retaining the latching lever in the latching lever unlocked position, the catch including a releasing mechanism for moving the catch from the holding configuration to a releasing configuration such that the latching lever returns to the latching lever locked position.

16. The apparatus of claim 8 wherein the delaying means includes a gap distance disposed between the ram in the first ram position and the latching lever when the latching lever is in the latching lever locked position.

17. The apparatus of claim 8 further comprising:

a hydraulic fluid return line in flow communication with the hydraulic cylinder and the hydraulic fluid reservoir for returning hydraulic fluid from the hydraulic cylinder to the hydraulic fluid reservoir; and a relief valve disposed in the hydraulic fluid return line, the relief valve having an open position and a closed position, the pump being operable to pressurize at least a portion of the hydraulic cylinder to move the latching lever from the latching lever locked position to the latching lever unlocked position when the relief valve is in the closed position, and wherein a portion of the hydraulic fluid moves from the hydraulic cylinder to the hydraulic fluid reservoir when the latching lever is moved from the latching lever unlocked position to the latching lever locked position and the relief valve is in the open position.

18. The apparatus of claim 17 further comprising a gap spring that moves the ram towards the high pressure chamber when the relief valve has moved from the closed position to the open position.

19. A delay unlatching mechanism for a closure comprising:

a latching lever operable to move between a latching lever locked position for inhibiting opening of the closure and a latching lever unlocked position for permitting opening of the closure;

a hydraulic fluid reservoir holding a hydraulic fluid;

a hydraulic cylinder in flow communication with the hydraulic fluid reservoir, the hydraulic cylinder including a piston coupled to a ram;

a pump to extract a portion of the hydraulic fluid from the reservoir and transfer it at a pressure greater than atmospheric pressure to the hydraulic cylinder, wherein at least one cycle of the pump pressurizes the hydraulic cylinder causing movement of the piston in the hydraulic cylinder such that the ram engages the latching lever and moves the latching lever from the latching lever locked position to the latching lever unlocked position; and a catch having a holding configuration for assisting in retaining the latching lever in the latching lever unlocked position, the catch including a releasing mechanism for moving the catch from the holding configuration to a releasing configuration such that the latching lever returns to the latching lever locked position.

* * * * *